US006578276B2

(12) United States Patent
Patton et al.

(10) Patent No.: US 6,578,276 B2
(45) **Date of Patent: *Jun. 17, 2003**

(54) APPARATUS AND METHOD FOR MARKING MULTIPLE COLORS ON A CONTOURED SURFACE HAVING A COMPLEX TOPOGRAPHY

(75) Inventors: David L. Patton, Webster, NY (US); John R. Fredlund, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/782,491

(22) Filed: Feb. 13, 2001

(65) Prior Publication Data

US 2001/0003871 A1 Jun. 21, 2001

Related U.S. Application Data

(63) Continuation-in-part of application No. 09/761,018, filed on Jan. 15, 2001, now Pat. No. 6,295,737, which is a continuation of application No. 09/014,321, filed on Jan. 27, 1998, now abandoned.

(51) Int. Cl.[7] ..... B43L 13/00; B43K 29/08

(52) U.S. Cl. ..... 33/18.1; 33/21.1; 33/26; 33/511; 101/35

(58) Field of Search ..... 33/18.1, 20.1, 33/20.2, 21.1, 21.2, 26, 27.01, 27.12, 32.1, 32.3, 34, DIG. 21, 511, 512, 1 K, 1 BB, 1 CC; 347/2, 4, 106, 107, 1; 101/35; 702/167, 168, 169, FOR 131; 358/1.1, 1.6, 1.18, 1.9; 382/285, 154

(56) References Cited

U.S. PATENT DOCUMENTS

| | | | | | |
|---|---|---|---|---|---|
| 4,045,397 | A | | 8/1977 | Parkinson | 524/262 |
| 4,138,686 | A | | 2/1979 | Graf | 347/74 |
| 4,233,895 | A | | 11/1980 | Wehler | 101/93.05 |
| 4,299,031 | A | * | 11/1981 | Collins et al. | 101/193 |
| 4,398,202 | A | * | 8/1983 | Henderson | 346/29 |
| 4,409,650 | A | * | 10/1983 | Noguchi | 219/124.34 |
| 4,547,968 | A | * | 10/1985 | Petersen | 33/32.1 |
| 4,580,914 | A | | 4/1986 | Wehler | 400/56 |
| 4,691,716 | A | * | 9/1987 | Tanne | 600/587 |
| 4,769,650 | A | | 9/1988 | Peng et al. | 347/4 |
| 4,796,201 | A | * | 1/1989 | Wake | 345/585 |

(List continued on next page.)

FOREIGN PATENT DOCUMENTS

EP 0 602 251 A1# 6/1994

*Primary Examiner*—Christopher W. Fulton
*Assistant Examiner*—R. Alexander Smith
(74) *Attorney, Agent, or Firm*—Norman Rushefsky

(57) ABSTRACT

Apparatus for marking a contoured surface having complex topography and preferably with multiple color marking. The apparatus comprises a movable marker for marking the surface and a sensor disposed in sensing relationship to the surface for sensing contour of the surface. A controller interconnecting the marker and the sensor is also provided for actuating the marker and for controllably moving the marker relative to the surface in response to the contour sensed by the sensor, so that the marker follows the contour of the surface at a predetermined distance therefrom and marks the surface.

14 Claims, 11 Drawing Sheets

U.S. PATENT DOCUMENTS 4,807,152 A * 2/1989 Lane et al. ..... 700/247
4,901,095 A * 2/1990 Perra, Jr. et al. ..... 347/20
4,935,616 A 6/1990 Scott ..... 250/214 VT
4,976,036 A * 12/1990 Yamanouchi et al. ..... 33/23.03
4,999,645 A 3/1991 Grattan et al. ..... 346/140.1
5,088,046 A * 2/1992 McMurtry ..... 700/161
5,088,055 A * 2/1992 Oyama ..... 702/168
5,110,615 A * 5/1992 Maiorca et al. ..... 427/8
5,119,109 A * 6/1992 Robertson ..... 347/2
5,127,037 A * 6/1992 Bynum ..... 378/4
5,144,330 A * 9/1992 Bennett ..... 347/2
5,172,987 A * 12/1992 Stellmach et al. ..... 400/56
5,255,352 A * 10/1993 Falk ..... 345/427
5,273,059 A * 12/1993 Gross et al. ..... 134/57 R
5,360,276 A * 11/1994 Petermann ..... 400/55
5,380,978 A * 1/1995 Pryor ..... 219/121.64
5,465,037 A * 11/1995 Huissoon et al. ..... 318/568.11
5,880,759 A 3/1999 Silverbrook ..... 347/55
5,906,005 A 5/1999 Niskala et al. ..... 2/206
6,123,021 A * 9/2000 Cameron ..... 101/41
6,126,270 A 10/2000 Lebens et al. ..... 347/48
6,135,654 A * 10/2000 Jennel ..... 400/61
6,212,784 B1 * 4/2001 Pittman ..... 33/18.1
6,228,168 B1 * 5/2001 Johnson ..... 118/255
6,236,013 B1 * 5/2001 Delzenne ..... 219/121.37
6,286,517 B1 * 9/2001 Weber et al. ..... 132/73
6,295,737 B2 * 10/2001 Patton et al. ..... 33/18.1
6,341,831 B1 * 1/2002 Weber et al. ..... 347/1
6,360,656 B2 * 3/2002 Kubo et al. ..... 101/35
6,430,820 B1 * 8/2002 Chessari et al. ..... 33/26
6,434,278 B1 * 8/2002 Hashimoto ..... 382/285

* cited by examiner

APPARATUS AND METHOD FOR MARKING MULTIPLE COLORS ON A CONTOURED SURFACE HAVING A COMPLEX TOPOGRAPHY

This application is a continuation-in-part of U.S. application Ser. No. 09/761,018, filed Jan. 15, 2001, now U.S. Pat. No. 6,295,737, entitled "APPARATUS AND METHOD FOR MAKING A CONTOURED SURFACE HAVING COMPLEX TOPOLOGY" by David L. Patton and John R. Fredlund which in turn is a continuation of U.S. application Ser. No. 09/014,321 filed Jan. 27, 1998, now abandoned.

BACKGROUND OF THE INVENTION

This invention generally relates to marking apparatus and methods and more particularly relates to an apparatus and method for marking a contoured surface having complex topography with multiple colors.

It is often desirable to place a color image on a three-dimensional object having a complex topography, such as a vase or a human bust statue. Usually this image is applied manually, which is timely and costly. Attempting to quickly apply the image manually to the object typically results in less precision in placement of the image on the object, which is an undesirable result. Therefore, it is desirable to provide a marking device capable of marking such a three-dimensional object having complex topography.

Devices for marking curved surfaces are known. One such device is disclosed in U.S. Pat. No. 5,119,109 entitled: "Method And Apparatus For Marking The Inside Surface Of Pipe", issued Jun. 2, 1992 in the name of John A. Robertson. This patent discloses a system wherein dot matrix characters are formed upon the inside surface of a pipe or other curved surface by an array of ink spray nozzles disposed within a marker head assembly. The marker head is moved by a carriage in a manner such that character pixels are formed during movement of the marker head along loci parallel with the longitudinal axis of the pipe. An indexing mechanism engages an outer surface of the pipe to index it from one marking locus to the next marking locus. Also, a translational mechanism moves the carriage from an off-line to an on-line position during operation of the device. However, this patent does not disclose measuring distance of the surface of the pipe from the marker head before marking begins. That is, this patent does not appear to disclose sensing distance of the surface from the marker head, which may be required in order to sequentially mark pipes having different diameters nor does it disclose printing images of multiple colors. Moreover, use of the Robertson device does not appear to assure uniform placement of ink on a contoured surface having complex topology, such as a vase or a human bust statue.

Therefore, there has been a long-felt need to provide an apparatus and method for suitably marking a contoured surface of complex topology in a manner which automatically determines the contour of the surface and quickly, yet precisely, applies a marking medium uniformly to predetermined portions of the surface and can provide multiple color marking to the surface.

SUMMARY OF THE INVENTION

The present invention resides in an apparatus for marking a contoured surface having complex topography. The apparatus comprises a movable color marker for marking the surface and a sensor disposed in sensing relationship to the surface for sensing contour of the surface. A controller interconnecting the marker and the sensor is also provided for actuating the marker and for controllably moving the marker relative to the surface in response to the contour sensed by the sensor, so that the color marker, preferably a multiple color marker, follows the contour of the surface at a predetermined distance therefrom and marks the surface.

An object of the present invention is to provide an apparatus and method for marking a contoured surface having complex topography in a manner which automatically determines the contour of the surface. A further object of the invention is the provision of a method and apparatus for applying multiple colors uniformly to predetermined portions of a contoured surface having a complex topography.

A feature of the present invention is the provision of a sensor for sensing contour of the surface.

Another feature of the present invention is the provision of a controller connected to the sensor for obtaining a three-dimensional map of the surface sensed by the sensor.

An advantage of the present invention is that marking medium is precisely applied evenly on predetermined portions of the surface in a timesaving manner.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2*a–e*, 3 and 4, there are shown several embodiments of the present invention, each of which is an apparatus, generally referred to as 10, for marking a color image 20 on a contoured surface 30 defined by an object 40 resting on a support platform 45. Surface 30 may have a complex (i.e., undulating or curvilinear) topology.

Figure 1:
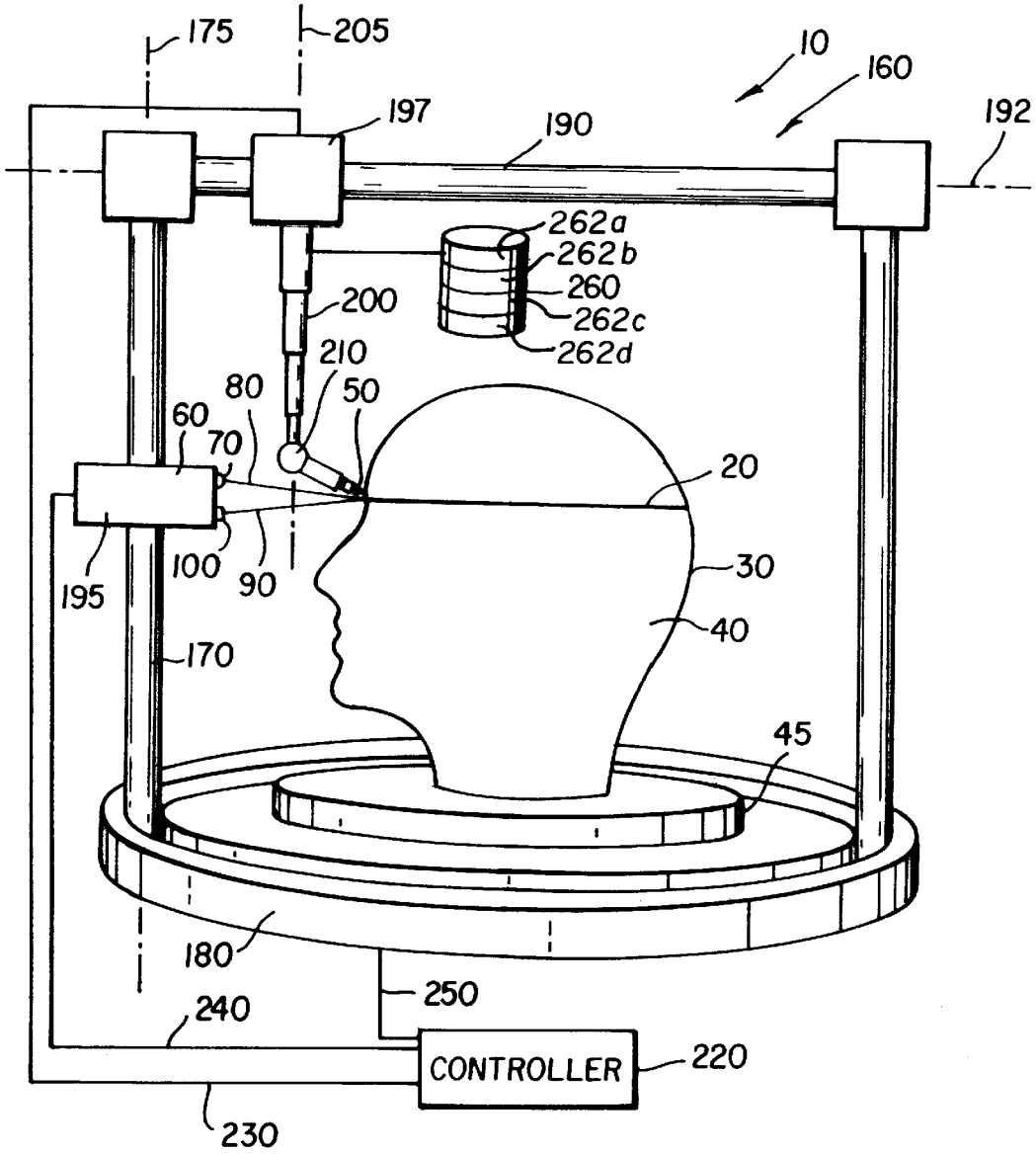
FIG. 1 is a view in elevation of one embodiment of the present invention showing a sensor comprising a laser system for measuring distance of a contoured surface from the sensor, the surface having a complex topography.
Figure 2A:
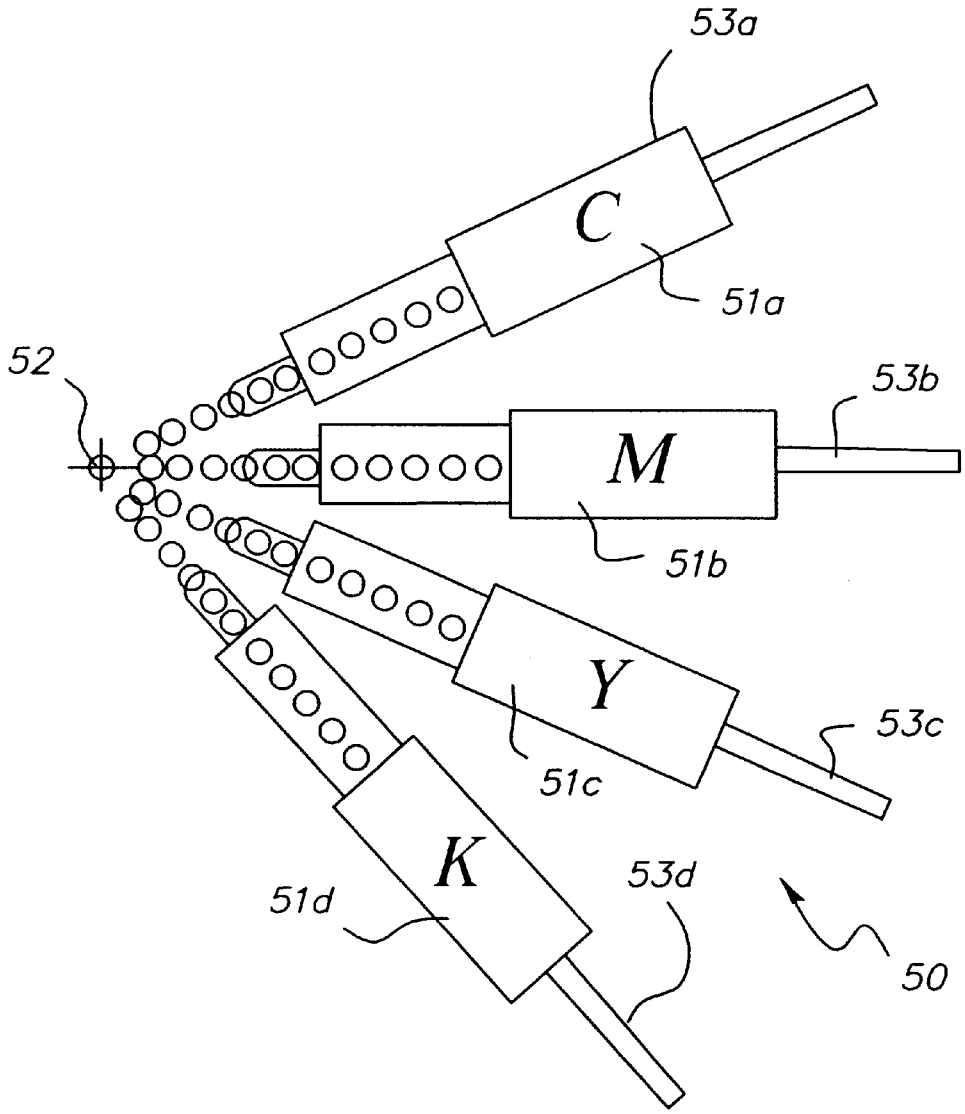
FIG. 2*a* is a fragmentary view showing a multiple color printhead forming a part of the embodiment of FIG. 1.

Referring now to FIG. 2*a*, apparatus 10 comprises a movable color printhead 50 comprised of a plurality of markers 51*a*, 51*b*, 51*c*, and 51*d*. The plurality of marking means 51*a* . . . *d* is pointed at the same spot 52. These markers 51*a* . . . *d* may be capable of marking in complementary color sets such as cyan 51*a*, magenta 51*b*, and yellow 51*c*, supplemented by black 51*d*, or any other number of colors deemed appropriate for generation of full-color images. Markers 51*a*, 51*b*, 51*c*, and 51*d* are connected to reservoir 260 via lines 53*a*, 53*b*, 53*c*, and 53*d*. Reservoir 260 shown in FIG. 1 can be divided into separate compartments 262*a*, 262*b*, 262*c*, and 262*d* holding cyan, magenta, yellow and black inks, dyes or pigments respectively. The respective color markers are connected to the respective compartments holding ink for the respective color marker.

Using this series of markers 51*a* . . . *d*, printhead 50 can create a full-color image 20 on the contoured surface 30 of object 40. In a preferred embodiment, the marking means are ink jet markers which may be a piezoelectric inkjet printhead of the type disclosed in commonly assigned U.S. Pat. No. 6,126,270 entitled: "Image Forming System And Method", filed Feb. 3, 1998, in the name of John Lebens, et al., the disclosure of which is hereby incorporated by reference. Alternatively, printhead 50 may be a thermal inkjet printhead of the type disclosed in commonly assigned U.S. Pat. No. 5,880,759, entitled: "A Liquid Ink Printing Apparatus And System", filed Dec. 3, 1996, in the name of Kia Silverbrook, the disclosure of which is hereby incorporated by reference.

The plurality of marking means 51*a* . . . *d* are pointed at the same spot 52 so that varying colors can be created with a single pass of the printhead 50. An alternate mechanism for creating fall color image 20 on the contoured surface 30 is achieved by moving the printhead 50 relative to a spot on the surface 30 so that each marker can mark the same spot in turn. The amount of movement of the printhead 50 is defined by the offset between the different markers in the printhead 50. The controls for the multihead multicolor printhead can also be programmed to provide for color marking of adjacent spots or spots somewhat spaced from each other. The multiple colors for a pixel may not exactly overlap but can have some overlap or else a close positioning relative to each other. Referring again to FIGS. 1, 2*a*, 2*b*, 3 and 4, a sensor 60 is disposed in sensing relationship to surface 30 for sensing contour of surface 30. As sensor 60 senses contour of surface 30, the sensor 30 generates a contour map corresponding to the contour of surface 30 sensed thereby, as described more fully hereinbelow. Sensor 60 is preferably a laser system comprising a photodiode light source 70 capable of emitting a laser light beam 80 to be intercepted by surface 30 and reflected therefrom to define a reflected light beam 90. In such a laser system, sensor 30 further comprises a light detector 100, which may be a CCD (Charged Couple Device) associated with light source 70 for detecting reflected light beam 90. In this regard, the laser system comprising light source 70 and detector 100 may be a modified "IMPULSE"™ model laser system available from Laser Technology, Incorporated located in Englewood, Col. Alternatively, sensor 60 may be a sound producing/detecting system comprising a sonic transducer 110 for emitting an ultra sound wave 120 to be intercepted by surface 30 and reflected therefrom to define a reflected sound wave 130. In such a sound producing/detecting system, sensor 60 further comprises a sonic detector 140 associated with transducer 110 for detecting reflected sound wave 130. In this regard, the sound producing/detecting system comprising sonic transducer 110 and sonic detector 140 may be a "Model 6500"™ sound producing/detecting system available from Polaroid located in Cambridge, Mass. As another alternative, sensor 60 may be a mechanical follower mechanism comprising a telescoping spring-loaded follower 150 having an end portion 155 (e.g., a rollable ball bearing) adapted to contact surface 30 and follow thereal-ong. In this case, telescoping follower 150 is capable of extending and retracting in order to follow contour of surface 30 and is also capable of generating an electrical signal indicative of the amount follower 150 extends and retracts with respect to contour of surface 30. It should be appreciated that sensor 60 and printhead 50 need not be pointing at the same location on surface 30 as long as the initial position of sensor 60 relative to the initial position of printhead 50 is known at the start of the mapping process.

Still referring to FIGS. 1, 2*a*, 2*b*, 3 and 4, a positioning mechanism, generally referred to as 160, is connected to marker 50 and sensor 60 for positioning marker 50 and sensor 60 relative to surface 30. Positioning mechanism 160 comprises at least one elongate leg 170 defining a longitudinal first axis 175 therethrough. Leg 170 also has an end portion thereof connected to a motorized rotatable base 180 which rotates leg 170 in a 360° circle around support platform 45. The other end portion of elongate leg 170 is connected to an elongate beam member 190 defining a longitudinal second axis 192 therethrough disposed orthogonally (i.e., at a 90° angle) to first axis 175. Moreover, positioning mechanism 160 further comprises a motorized first carriage 195 which slidably engages leg 170 and to which sensor 60 is connected, so that sensor 60 is capable of slidably moving along leg 170 in the direction of first axis 175. In addition, positioning mechanism 160 comprises a motorized second carriage 197 which slidably engages beam member 190 and to which printhead 50 is connected, so that printhead 50 is capable of slidably moving along beam member 190 in the direction of second axis 192. More specifically, printhead 50 is connected to a telescoping arm 200 which in turn is connected to beam member 190. Connecting printhead 50 to arm 200 allows distance between printhead 50 and surface 30 to be held constant by adjustment of the amount of extension of arm 200. Maintaining constant distance between printhead 50 and surface 30 allows a marking medium (e.g., colored ink) to be uniformly applied to surface 30.

Figure 2B:
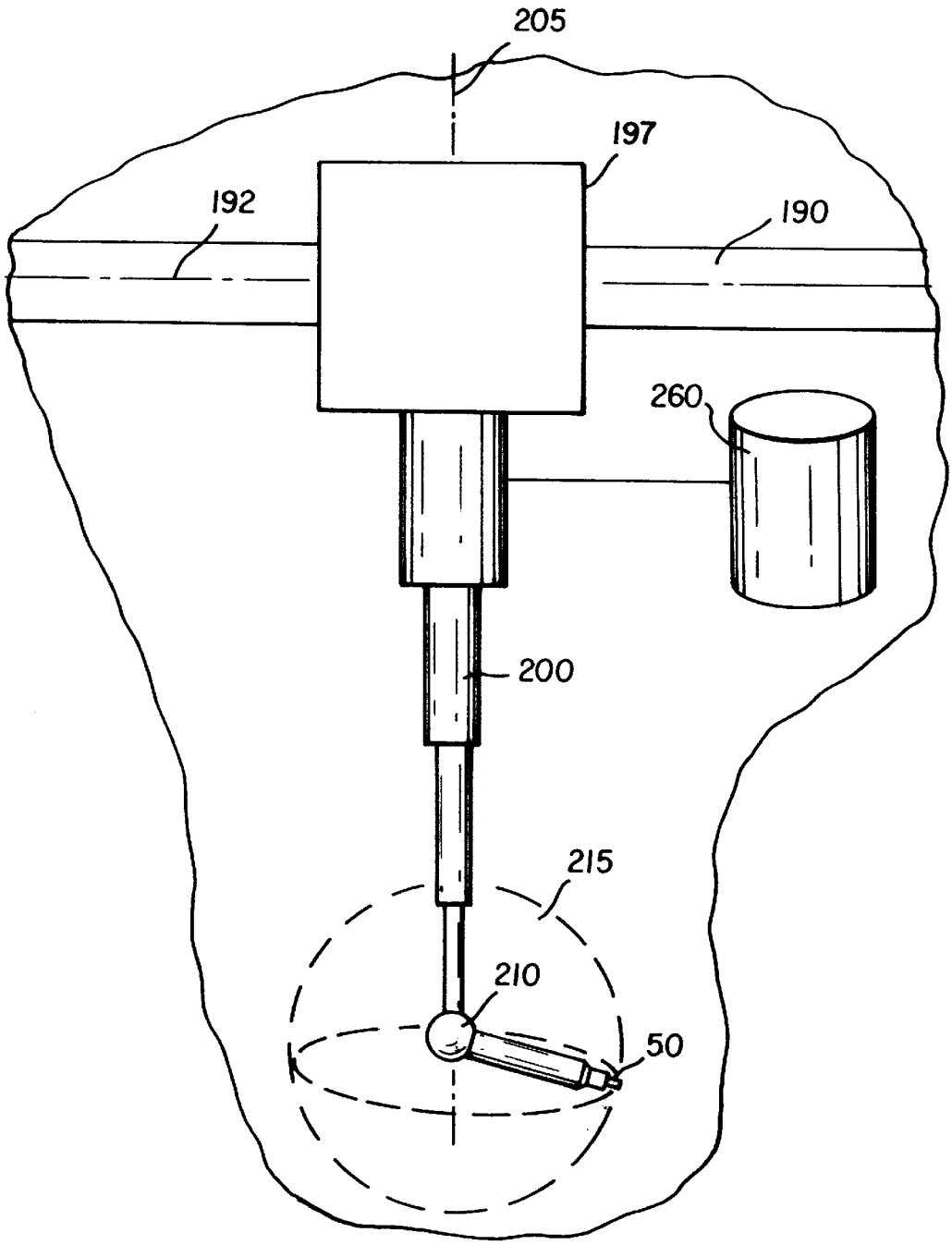
FIG. 2*b* is a fragmentary view showing a telescoping arm connected to a printhead forming a part of the embodiment of FIG. 1.

Referring to FIG. 2*b*, to achieve this result, telescoping arm 200 is capable of telescoping printhead 50 outwardly away from and inwardly towards second carriage 197 along a third axis 205 running longitudinally through telescoping arm 200. Instead of a telescoping device a rack and pinion or cam in slot or other type of mechanical coupling can be used to constrain movement of the joint 210 and the printhead for linear movement. Further, the joint 210 is a ball-in-socket joint that preferably interconnects printhead 50 and arm 200 for moving printhead 50 in a path defined by a lune 215 centered about third axis 205 and circumscribing a 360° circle around arm 200, as best illustrated by dashed lines in FIG. 2. Ball-in-socket joint 210 is movable by means of a linkage (not shown) interconnecting ball-in-socket joint 210 with second carriage 197.

Referring yet again to FIGS. 1, 2*a*, 2*b*, 3 and 4, it may be appreciated that printhead 50 obtains at least three degrees freedom of movement relative to surface 30 in order to mark substantially any portion of surface 30. That is, printhead 50 is capable of moving around object 40 in a 360° circle to define a first degree freedom of movement because printhead 50 is connected to beam member 190 which in turn is connected to leg 170 that is connected to rotatable base 180. Thus, as rotatable base 180 moves leg 170 in the 360° circle around object 40, printhead 50 will also move to a like extent in a 360° circle around object 40. In addition, printhead 50 is capable of moving in a direction outwardly away from and inwardly towards second carriage 197 along third axis 205 to define a second-degree freedom of movement. Moreover, printhead 50 is capable of moving, by means of ball-in-socket joint 210, in the path traveled by lune 215 to define at least a third degree freedom of movement. It is important that printhead 50 have at least three degrees freedom of movement. This is important in order to provide printhead 50 access to substantially any portion of surface 30 for marking substantially any portion of surface 30. In fact, an inspection of FIG. 2 shows that printhead 50 in fact obtains five degrees of freedom of movement as follows: (1) rotatable base 180 rotates printhead 50 horizontally in a 360 degree circle; (2) telescoping arm 200 moves printhead 50 vertically; (3) ball-in-socket joint 210 moves printhead 50 horizontally in a 360 degree circle; and (4) ball-in-socket joint 210 moves printhead 50 vertically and 360 degrees circle; and (5) second carriage 197 moves printhead 50 horizontally along beam member 190. The five degrees of freedom allows the printhead to have its change orientation changed relative to points on the surface so that it is effectively printing at a different angle relative to certain points on the surface because of the need to print at certain difficult to reach points such as under the nose of the face being printed comprising the object 40.

Referring again to FIGS. 1, 2*a*, 2*b*, 3 and 4, it may be appreciated that sensor 60 obtains two degrees freedom of movement relative to surface 30. That is, sensor 60 is capable of moving around object 40 in a 360° circle to define a first degree freedom of movement because sensor 60 is connected to leg 170, which in turn is connected to rotatable base 180. As previously mentioned, base 180 moves leg 170 in the 360° circle around object 40. In addition, sensor 60 is capable of moving in a direction along first axis 175 to define a second-degree of freedom of movement for sensor 60. It is important that sensor have at least two degrees freedom of movement. This is important to allow sensor 60 sufficient access to portions of surface 30 to be mapped by sensor 60 in the manner described hereinbelow.

Still referring to FIGS. 1, 2*a*, 2*b*, 3 and 4, a controller 220 is connected to printhead 50, sensor 60 and positioning mechanism 160 for controlling positioning of printhead 50 and sensor 60. With respect to controlling positioning of printhead 50, controller 220 is connected to second carriage 197, such as by means of a first cable 230, for activating second carriage 197, so that second carriage 197 controllably slides along beam member 190. As controller 220 activates carriage 197, controller 220 may also controllably activate arm 200 for telescoping printhead 50 along third axis 205 to a predetermined constant distance from surface 30. Further, as controller 220 activates arm 200, controller 220 may also controllably activate ball-in-socket joint 210, by means of the previously mentioned linkage (not shown), for moving printhead 50 in the path traveled by lune 215. Of course, a reservoir 260 is connected to printhead 50 for supplying the marking medium (e.g., colored ink) to printhead 50. Reservoir 260 can be divided into separate compartments 262*a*, 262*b*, 262*c*, and 262*d* holding cyan, magenta, yellow and black inks, dyes or pigments respectively.

Again referring to FIGS. 1, 2*a*, 2*b*, 3 and 4, in order to control positioning of sensor 60, controller 220 is connected to first carriage 195, such as by means of a second cable 240, for activating first carriage 195, so that first carriage 195 controllably slides along leg 170. Moreover, controller 220 is connected to base 180 for controlling rotation of base 180. More specifically, controller 220 is connected to base 180, such as by means of a third cable 250, for activating base 180, so that base 180 controllably rotates in the previously mentioned 360° circle around support platform 45 and thus around object 40. Moreover, controller 220 performs yet other functions. As described in detail hereinbelow, controller 220 stores image 20 therein, actuates sensor 60 to allow mapping contoured surface 30 as sensor travels about surface 30, and activates printhead 50 to apply image 20 to surface 30 according to the map of surface 30 stored in controller 220.

Another mechanism for marking the surface 30 in color is to duplicate apparatus 10 for each color. By this means, each color can be simultaneously applied separately to different portions of object 40.

Figure 2C:
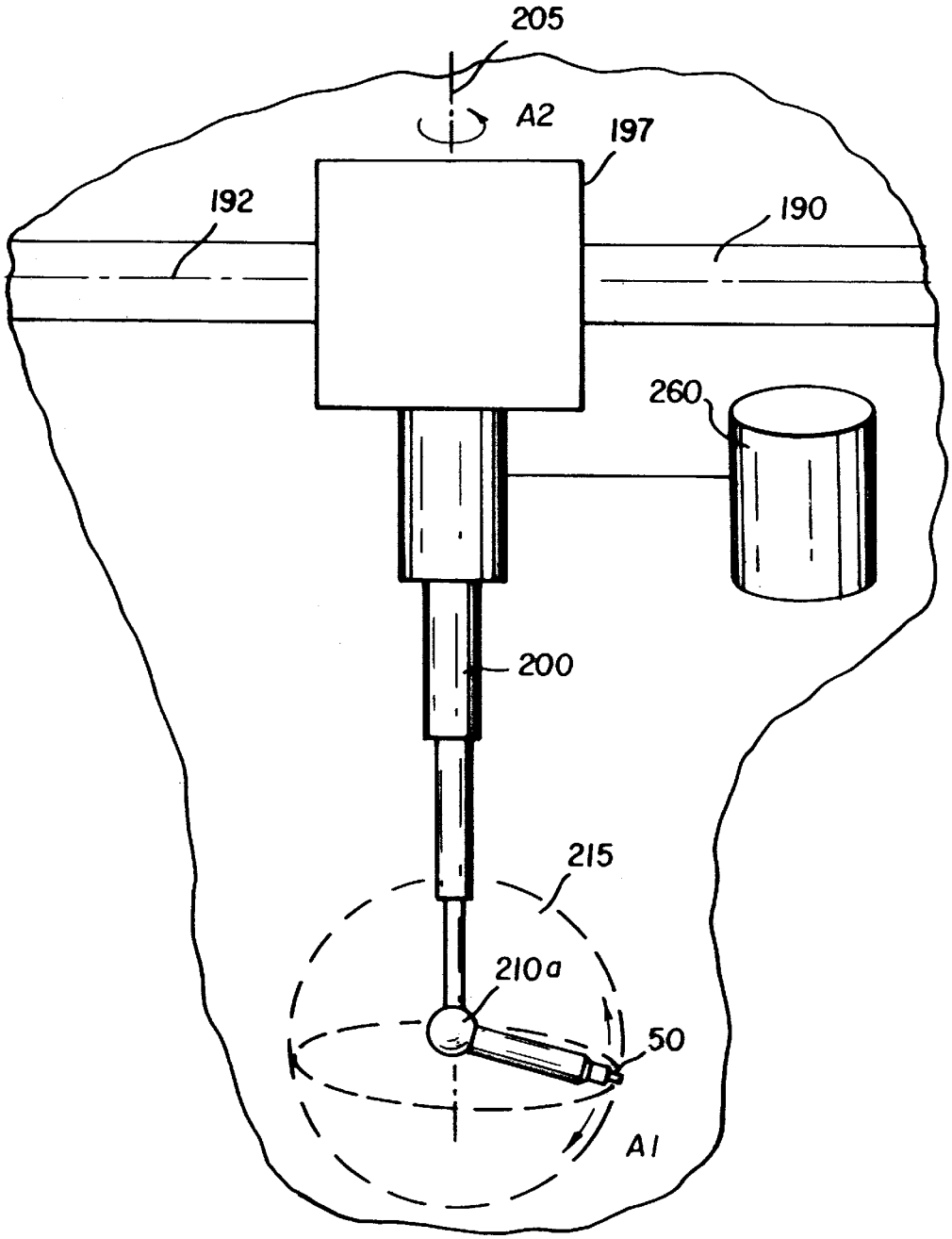
FIG. 2*c* is a fragmentary view showing a telescoping arm connected to a printhead and comprising an alternative embodiment.
Figure 2D:
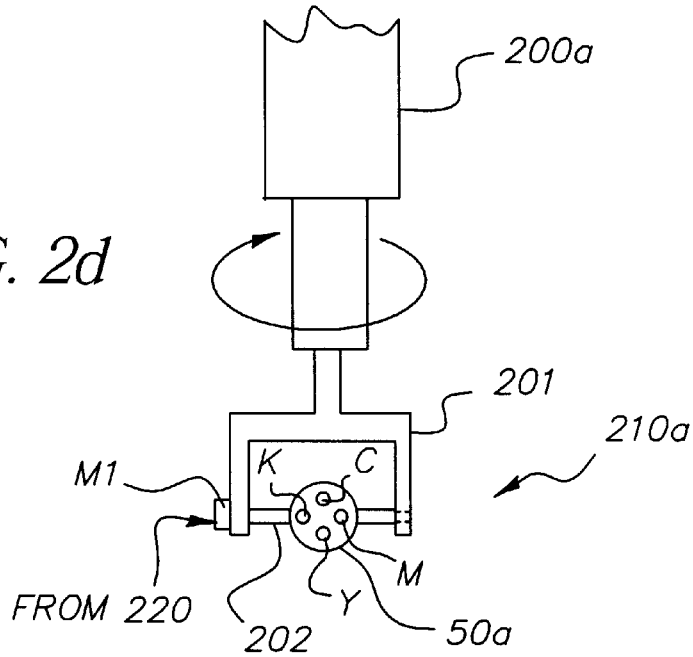
FIG. 2*d* is a fragmentary view of the telescoping arm in FIG. 2*c* and illustrating in more detail the connection of the printhead to a pivoting joint.
Figure 2E:
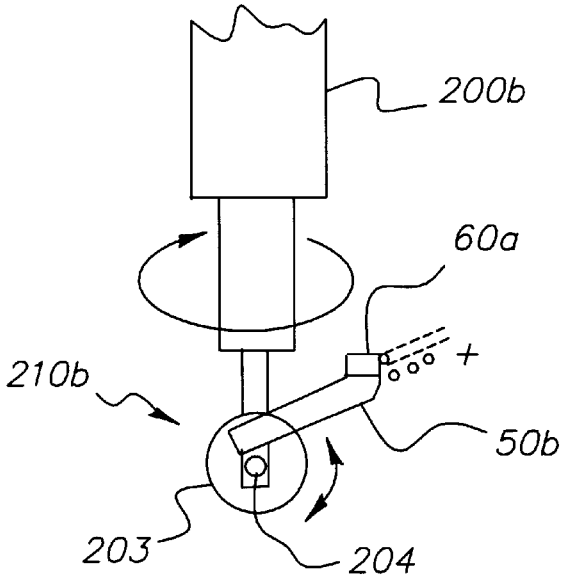
FIG. 2*e* is a fragmentary view of the telescoping arm in FIG. 2*c* but illustrating a pivoting joint with eccentric rotation.
Figure 3:
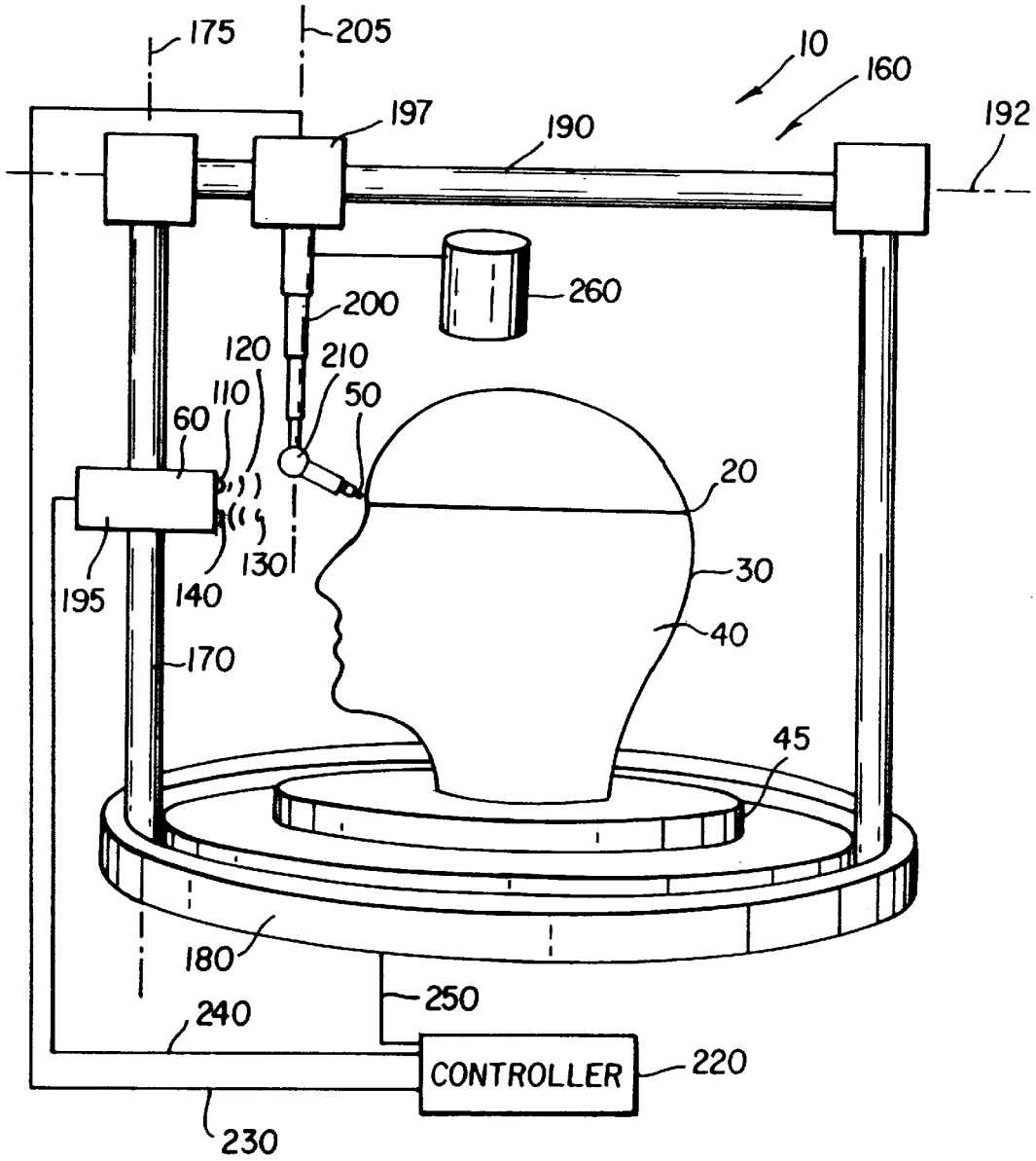
FIG. 3 is a view in elevation of a second embodiment of the present invention showing a sensor comprising a ultra sound producing/detecting system for measuring distance of the contoured surface from the sensor.
Figure 4:
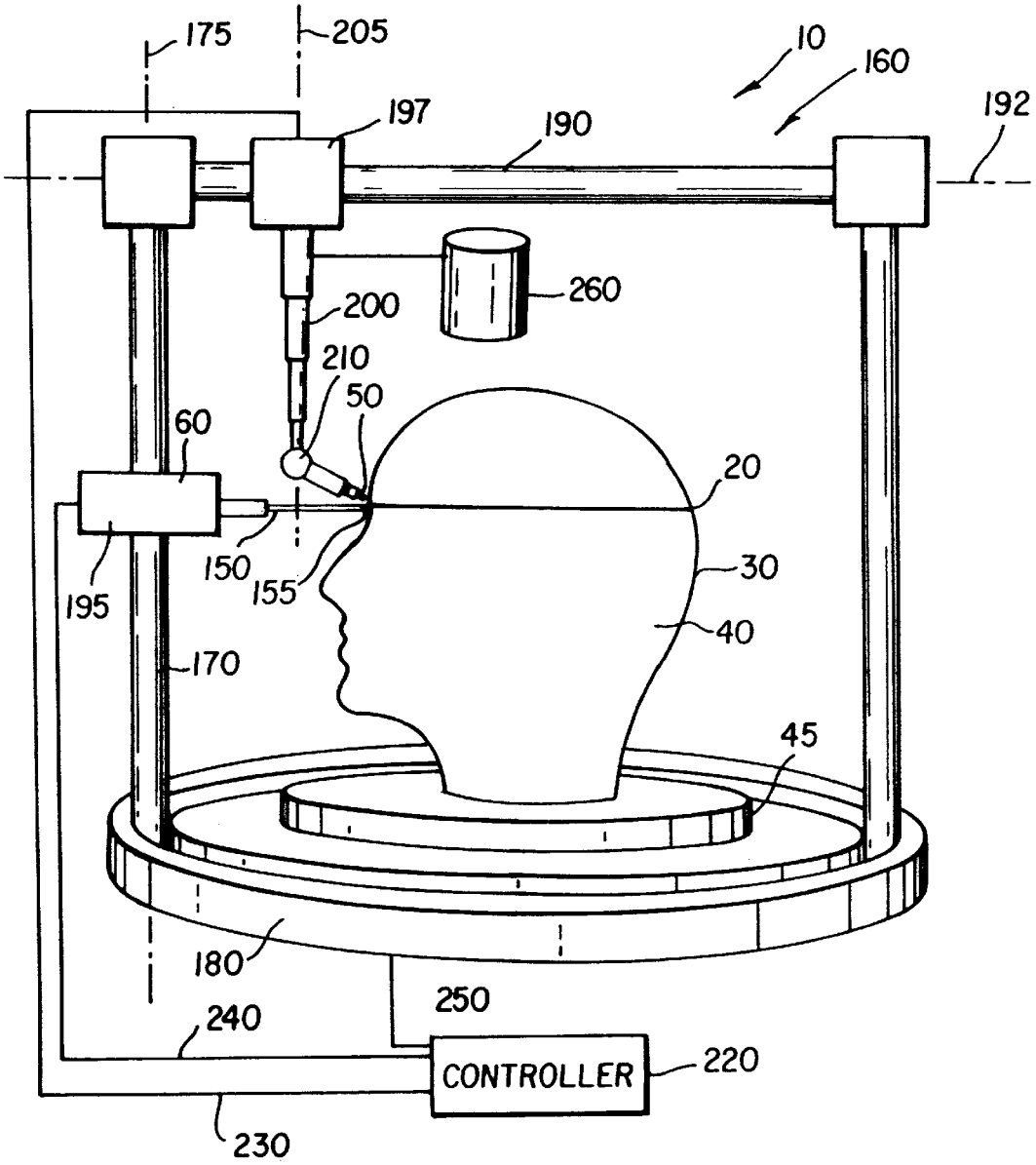
FIG. 4 is a view in elevation of a third embodiment of the present invention showing a sensor comprising a mechanical follower for measuring distance of the contoured surface from the sensor.

Referring now to FIGS. 2*c* and 2*d* an alternate embodiment of a pivotable joint 210*a* is illustrated wherein the ball-in-socket has been replaced by a clevis and pin connection wherein the printhead is mounted on a pin 202 for pivotable motion about the axis of the pin 202. The pin is supported by clevis 201 which in turn is rotatable about the axis (A2) of telescoping arm 200*a* or other linear motion constraining device. A motor M1 or other mechanical mechanism is controlled by signals from controller 220 to pivot the pin 202 and thereby rotate the printhead 50*a* in the directions indicated by arrows A1. The printhead 50*a* may have plural nozzle openings each constituting a different color marker. With reference now to FIG. 2*e* there is illustrated still another embodiment of a pivotable joint 210*b* which also employs a clevis and pin type of device where however the pin is enlarged and in the form of a roller or disk 203 that pivots about pin 204. The printhead 50*b* is mounted on the disk eccentric to the axis of the disk. In the embodiment of FIG. 2*e* the sensor 60*a* is mounted directly on the printhead 50*b* and aimed at the same point on the object as the printhead.

Figure 5:
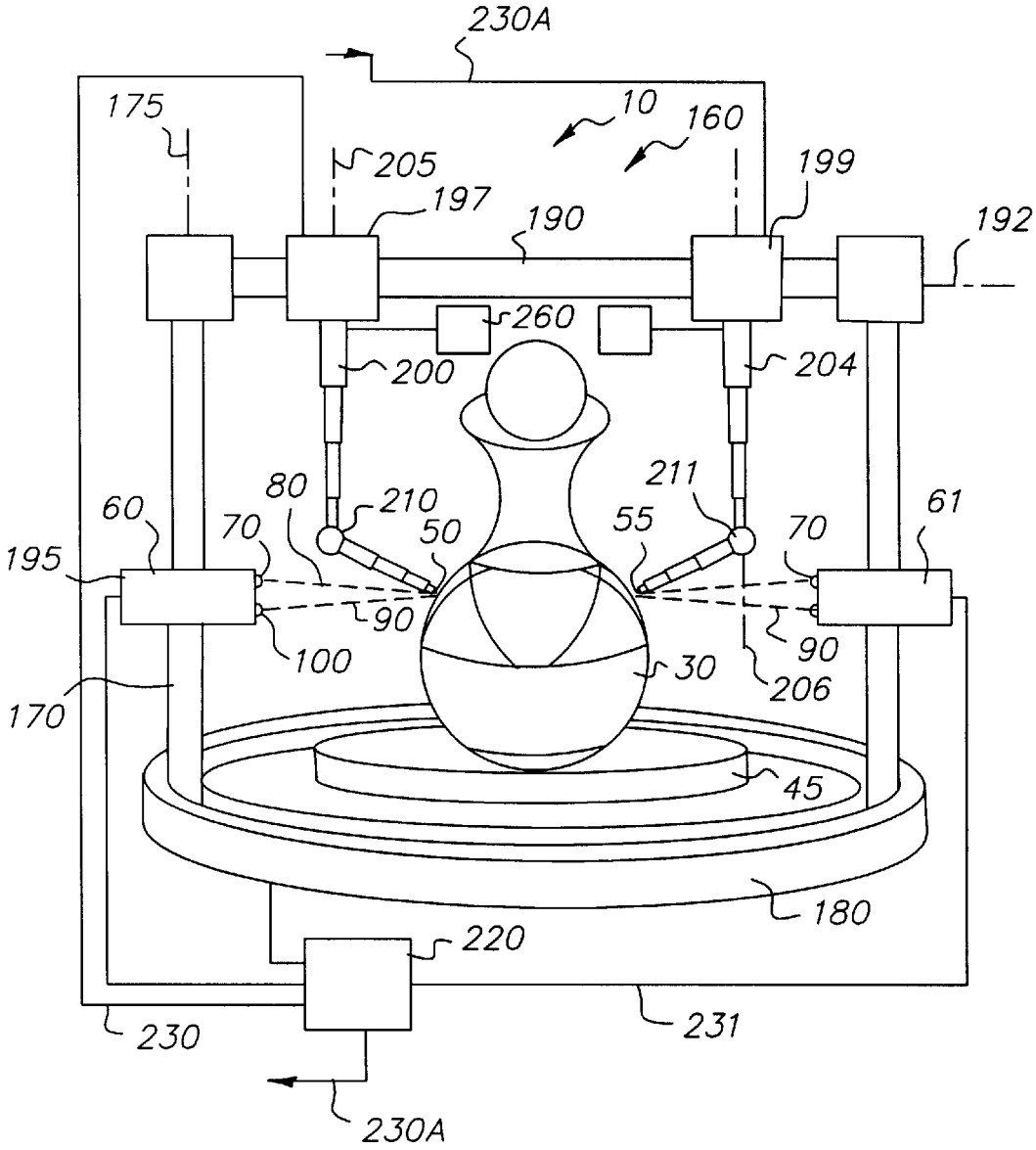
FIG. 5 is a view in elevation of still another alternative embodiment of the invention.
Figure 6A:
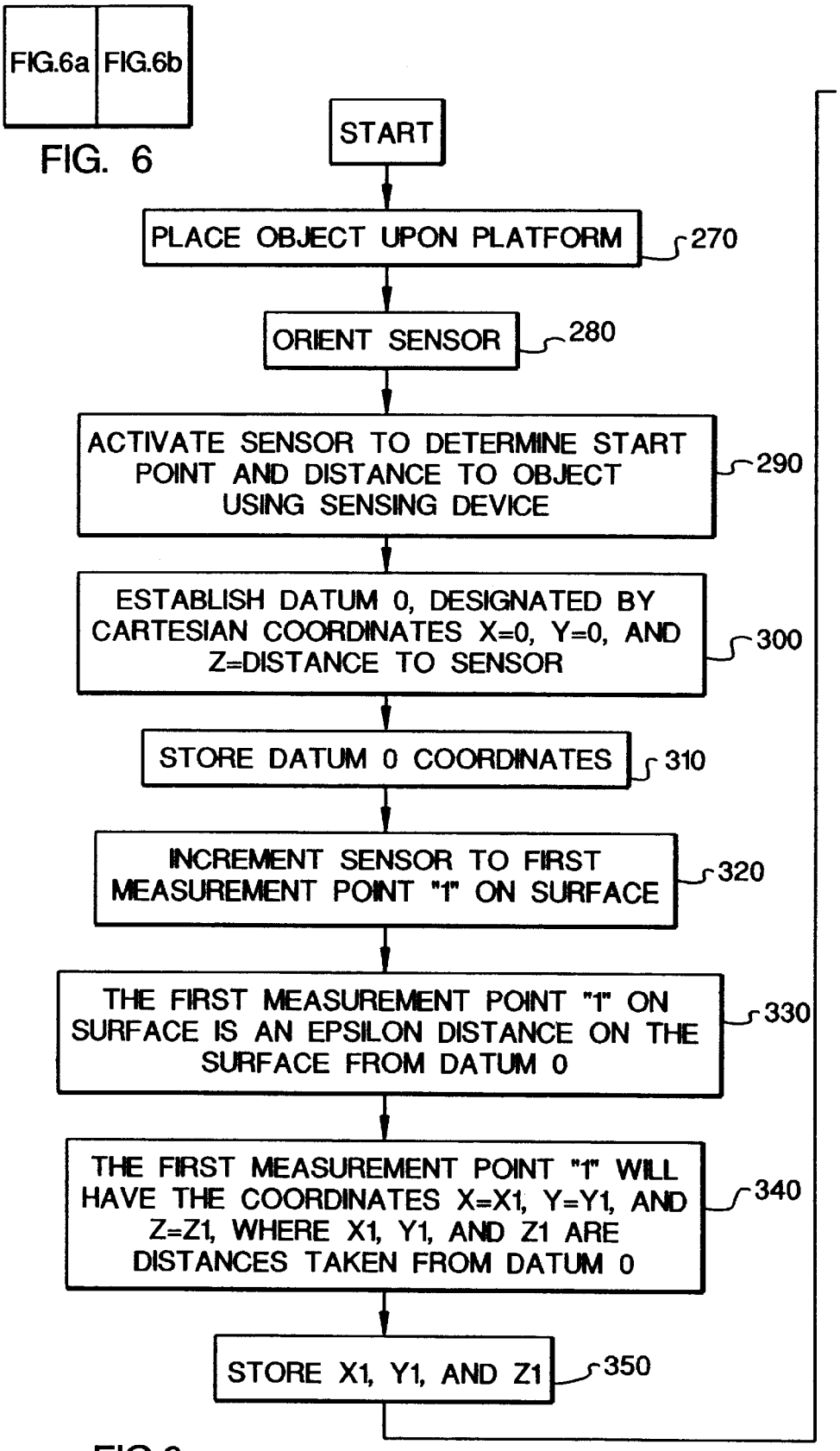
FIG. 6 is a logic flowchart of a process for mapping an image onto the surface.
Figure 6B:
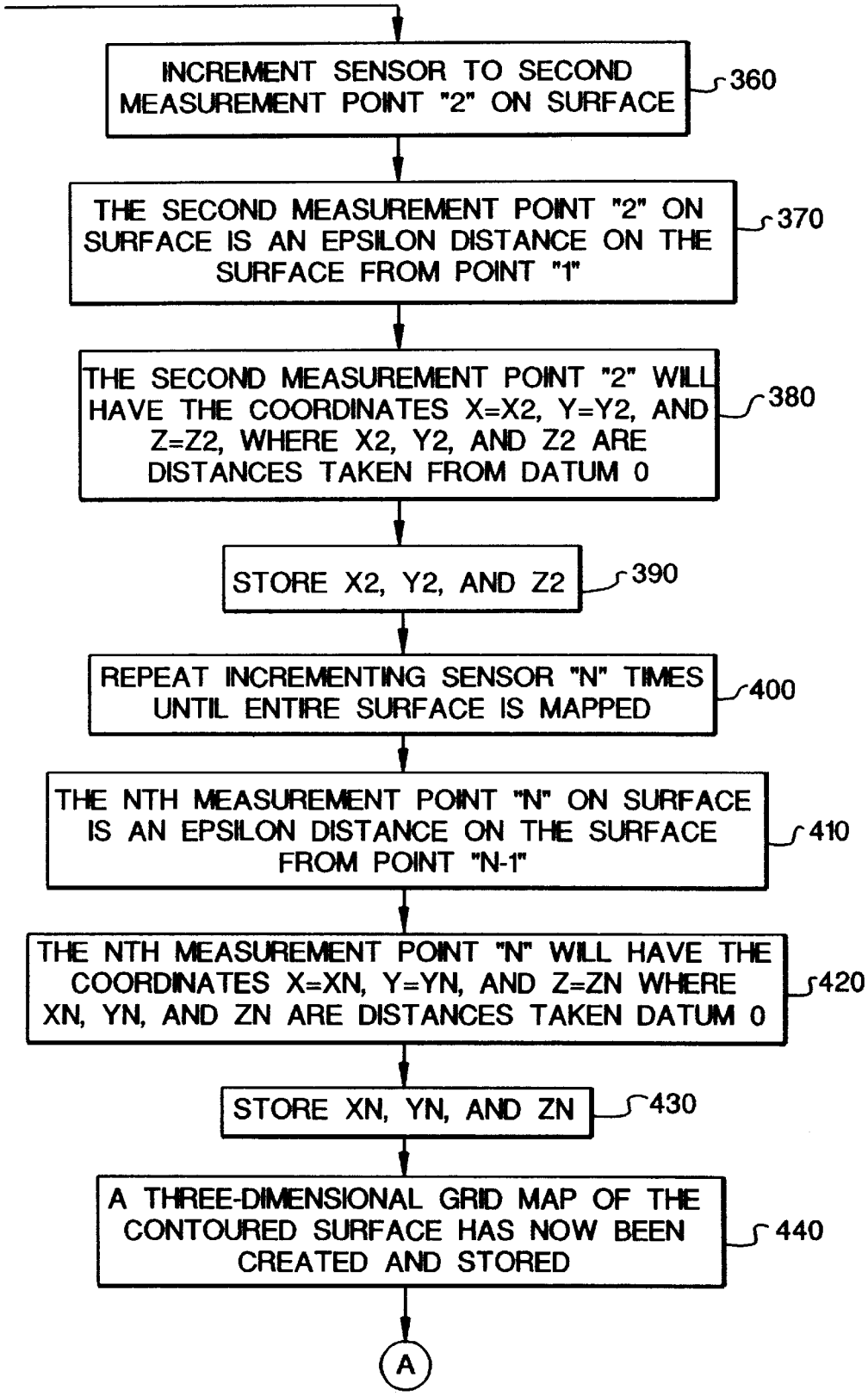
Figure 7:
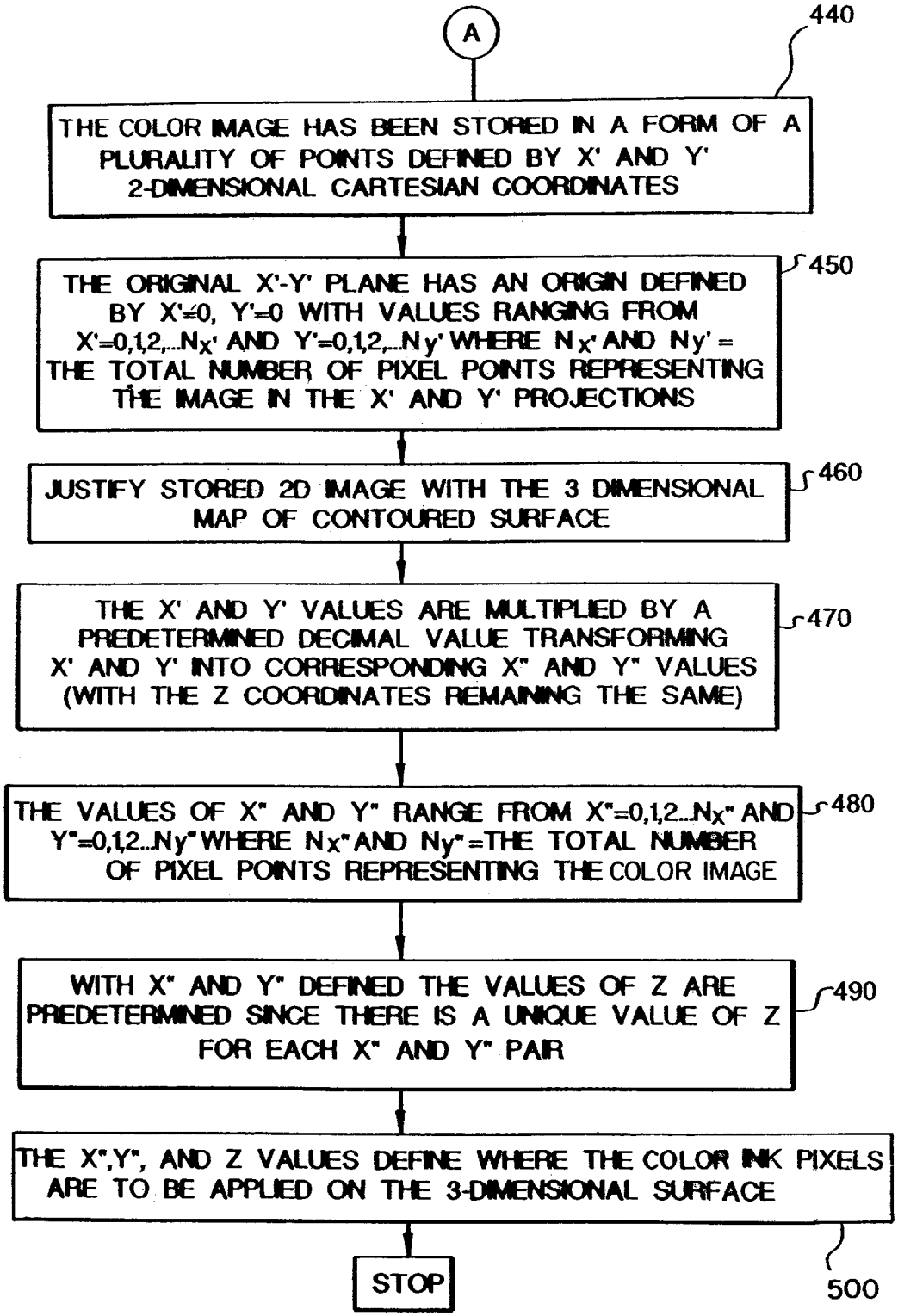
FIG. 7 is a continuation of the logic flowchart begun in FIG. 6.

Referring to FIG. 5, a positioning mechanism, generally referred to as 160, is connected to printheads 50 and 55 and sensor 60 for positioning printheads 50 and 55 and sensor 60 relative to surface 30. Positioning mechanism 160 comprises at least one elongate leg 170 defining a longitudinal first axis 175 therethrough. Leg 170 also has an end portion thereof connected to a motorized rotatable base 180 which rotates leg 170 in a 360° circle around support platform 45. The other end portion of elongate leg 170 is connected to an elongate beam member 190 defining a longitudinal second axis 192 therethrough disposed orthogonally (i.e., at a 90° angle) to first axis 175. Moreover, positioning mechanism 160 further comprises a motorized first carriage 195 which slidably engages leg 170 and to which sensor 60 is connected, so that sensor 60 is capable of slidably moving along leg 170 in the direction of first axis 175. In addition, positioning mechanism 160 comprises a motorized second carriage 197 which slidably engages beam member 190 and to which printheads 50 and 55 are connected, so that printheads 50 and 55 are capable of slidably moving along beam member 190 in the direction of second axis 192. More specifically, printheads 50 and 55 are connected to a telescoping arm 200 and 204 respectively which in turn are connected to beam member 190. Connecting printhead 50 to arm 200 allows distance between printhead 50 and surface 30 to be held constant by adjustment of the amount of extension of arm 200. Likewise connecting printhead 55 to arm 204 allows distance between printhead 55 and surface 30 to be held constant by adjustment of the amount of extension of arm 204. Maintaining constant distance between printheads 50 and 55 and surface 30 allows a marking medium (e.g., colored inks) to be uniformly applied to surface 30. The printheads 50 and 55 each can be either a multiple color inkjet printhead, as shown in FIG. 2*a* with two, three or four printheads or a single color inkjet printhead. To achieve this result, telescoping arms 200 and 204 are capable of telescoping printheads 50 and 55 outwardly away from and inwardly towards second and third carriages 197 and 199 respectively along a third axis 205 running longitudinally through telescoping arms 200 and 204. Further, a ball-in-socket joint 210 preferably interconnects printhead 50 and arm 200 for moving printhead 50 in a path defined by a lune 215 centered about third axis 205 and circumscribing a 360° circle around arm 200, as best illustrated by dashed lines in FIG. 2*b*. Ball-in-socket joint 210 is movable by means of a linkage (not shown) interconnecting ball-in-socket joint 210 with second carriage 197. Likewise, a ball-in-socket joint 211 preferably interconnects printhead 55 and arm 204 for moving printhead 55 in a path defined by a lune centered about third axis 206 and circumscribing a 360° circle around arm 204. The movement of printhead 55 is similar to movement of printhead 50 shown in FIG. 2*b*. Ball-in-socket joint 211 is movable by means of a linkage (not shown) interconnecting ball-in-socket joint 211 with third carriage 199.

Still referring to FIG. 5, a controller 220 is connected by connection 230, 230A to printheads 50, 55, sensor 60 and positioning mechanism 160 for controlling positioning and other control signals for operating printheads 50, 55 and sensor 60. In some cases it may be desirable for each printhead 50 and 55 to be positioned using separate sensors 60 and 61 respectively. In the case where each printhead has its own separate sensor 61 is connected to controller 220 via a fourth cable 231. With respect to controlling positioning of printheads 50 and 55, controller 220 is connected to second and third carnages 197 and 199 respectively, such as by means of a first cable 230 and a second cable 230A respectively, for activating second carriage 197 and third carriage 199, so that second and third carriage 197 and 199 controllably slides along beam member 190. As controller 220 activates carriage 197, controller 220 may also controllably activate arm 200 and 204 for telescoping printheads 50 and 55 respectively along respective third axes 205 and 206 to a predetermined constant distance from surface 30. Further, as controller 220 activates arm 200, controller 220 may also controllably activate ball-in-socket joint 210, by means of the previously mentioned linkage (not shown), for moving printhead 50 in the path traveled by lune 215. Likewise, controller 220 activates arm 204, controller 220 may also controllably activate ball-on-socket joint 211, by means of the previously mentioned linkage (not shown), for moving printhead 55 in a similar path traveled by lune 215. Of course, a reservoir 260 and 261 are connected to printheads 50 and 55 respectively for supplying the marking medium (e.g., colored inks) to printheads 50 and 55. Similarly, for the embodiment of FIG. 5, the pivotable connection of FIGS. 2*c–e* may be used instead of the ball-in-socket connection 210, 211 shown in FIG. 5. It also may be desirable to have each of printheads 50 and 55 shown in FIG. 5 have plural inkjet color marking devices so that two or more colors may be applied by each printhead. Thus this can provide for use of special color inks (in addition to cyan, magenta, yellow and black) that are not easily reproducible with the cyan, magenta, yellow and black color inks.

Therefore, referring to FIGS. 1, 2*a*, 2*b*, 3, 4, 6 and 7, the manner in which surface 30 is mapped into x, y and z Cartesian coordinates will now be described. First, object 40 is placed upon platform surface 45 by an operator of apparatus 10 as at Step 270. Either the operator or controller 220 then orients sensor 60 in the direction of object 40 as at Step 280. Next, controller 220 activates sensor 60 such that distance from sensor 60 of an initial point on surface 30 is determined as at Step 290. That is, sensor 60 effectively determines distance or proximity of object 40 from sensor 60. Distance of this initial point is determined either by use of light beams 80/90, sound waves 120/130 or follower 150. This initial point is designated as a datum point "0" and will have Cartesian coordinates of x=0, y=0 and z distance from sensor 60 as at Step 300. Other types of coordinate systems such as a polar coordinate system can be used to map the surface. These x, y and z coordinates for datum point "0" are then transmitted by second cable 240 to controller 220 and stored therein as at Step 310. Controller 220 then activates first carriage and/or base 180 to increment sensor 60 a predetermined amount in order to sense a first measurement point "1" on surface 30 as at Step 320. This first measurement point "1" is located at an epsilon or very small distance "δ" on surface 30 in a predetermined direction from datum point "0" as at Step 330. Moreover, this first measurement point "1" will have coordinates of $x=x_1$, $y=y_1$, and $z=z_1$, where the values of $x_1$, $y_1$ and $z_1$ are distances defining location of measurement point "1" from datum point "0" in the well-known three-dimensional Cartesian coordinate system as illustrated by Step 340. The coordinates of measurement point "1" are then transmitted by second cable 240 to controller 220 and stored therein as at Step 350. Controller 220 then activates first carriage and/or base 180 to increment sensor 60 epsilon distance "δ" to a second measurement point "2" on surface 30 as at Step 360. That is, this second measurement point "2" is located at the epsilon distance "δ" on surface 30 in a predetermined direction from first measurement point "1" as illustrated by Step 370. Moreover, this second measurement point "2" will have coordinates of $x=x_2$, $y=y_2$ and $z=z_2$, where the values of $x_2$, $y_2$ and $z_2$ are distances defining separation of measurement point "2" from datum point "0" in the three-dimensional Cartesian coordinate system as illustrated by Step 380. These coordinates of second measurement point "2" are then transmitted by second cable 240 to controller 220 and stored therein as at Step 390. In similar manner, controller 220 activates first carriage and/or base 180 to increment sensor 60 by increments equal to epsilon distance "δ" about the entire surface 30 to establish values of x=0, 1, . . . $n_y$; y=0, 1, . . . n; and z=0, 1, 2, . . . $n_z$, where $n_x$, $n_y$ and $n_z$ equal the total number of measurement points to be taken on surface 30 in the x, y and z directions, respectively as at Step 400. Each measurement point is spaced-apart from its neighbor by epsilon distance "δ" as illustrated by Step 410. In this manner, all measurement points describing surface 30 are defined relative to initial datum point "0", which is defined by x=0, y=0 and z=distance from sensor 60 as illustrated by Step 420. The process disclosed hereinabove results in a three-dimensional grid map of contoured surface 30 being stored in controller 220 as x, y and z coordinates as at Steps 430, 440 and 450. Alternately the entire surface need not be mapped if known features of a known object are detected.

Referring again to FIGS. 1, 2*a*, 2*b*, 3, 4, 6 and 7 controller 220 performs a calculation which justifies color image 20 stored therein with the x, y and z map of surface 30 as at Step 460. Preferably color image 20 has been previously stored in controller 220 and represented therein in the form of a plurality of color points defined by x' and y' two-dimensional Cartesian coordinates. That is, each point in color image 20 stored in controller 220 has been previously assigned x', y' and a color value for each x' and y' value representing color image 20 in the x'-y' two-dimensional plane. This x'-y' plane has an origin defined by values of x'=0 and y'=0. The values in the x'-y' plane range from x'=0, 1, 2, . . . $n_{x'}$ and from y'=0, 1, 2, . . . $n_{y'}$, where $n_{x'}$ and $n_{y'}$ equal the total number of color pixel points representing color image 20 in the x' and y' directions, respectively. Controller 220 then mathematically operates on the values defining the x'-y' plane of color image 20 in order to justify the x', y' and color values forming color image 20 to the x and y measurement values forming color map of surface 30. That is, controller 220 multiplies each x' and y' value by a predetermined scaling factor, so that each x' and y' value is respectively transformed into corresponding x" and y" values as at Step 470. The transformation can be preformed via texture mapping techniques such as those described in *Advanced Animation and Rendering Techniques Theory and Practice* by Watt and Watt. These techniques are well known in the art.

The z coordinates of the measurement values obtained by sensor 60 remain undisturbed by this justification. That is, after controller 220 scales the x' and y' values, controller 220 generates corresponding x" and y" values (with the z coordinate values remaining undisturbed). The x" values range from x"=0, 1, 2, . . . $n_{x''}$ and the y" values range from y"=0, 1, 2, . . . $n_{y''}$, where $n_{x''}$ and $n_{y''}$ equal the total of pixel points representing image 20 in the x" and y" directions, respectively as illustrated by Step 480. It should be understood from the description hereinabove, that once the values of x" and y" are defined, the values of z are predetermined because there is a unique value of z corresponding to each x" and y" pair as illustrated by Step 490. These values of x", y" and z define where color ink pixels are to be applied on surface 30 as illustrated by Step 500. As described hereinbelow, after the map and color image 20 stored in controller 220 are justified, controller 220 controls printhead 50 and positioning mechanism 160 to print the now justified color image 20 on surface 30. If desired, the position of a significant portion (e.g., the nose on a bust statue) of color image 20 in the x-y plane stored in controller 220 may be matched to the corresponding significant portion of object 40 stored in the x'-y' plane in order to obtain the necessary justification.

Again referring to FIGS. 1, 2*a*, 2*b*, 3, 4, and 5 controller 220 transmits a signal to second carriage 197, arm 200, ball-in-socket joint 210 and/or base 180 to position printhead 50 at the first color pixel point to be printed. This first pixel point is located on surface 30 at a location defined by x"=1, y"=1 and the z value uniquely associated therewith. That is, once x"=1 and y"=1 are defined, the value of z corresponding to the pair of values for x"=1 and y"=1 is predetermined. Next, controller 220 activates printhead 50 to expel ink at the location on surface 30 corresponding to x"=1, y"=1 and the associated z value in order to mark surface 30 thereat. If desired, the z value is scaled such that printhead 50 is always spaced a predetermined distance from surface 30 in order to uniformly apply color inks to surface 30. The process described hereinabove is repeated until all of color image 20 is marked on surface 30.

As best seen in FIG. 2*e*, an alternative embodiment of the present invention is there shown for marking contoured surface 30. In this alternative embodiment of the invention, printhead 50*b* and sensor 60*a* are combined into one assembly. This alternative embodiment of the invention eliminates need for first carriage 195 and second cable 240. Instructions to both printhead 50 and sensor 60 are transmitted thereto from controller 220 over first cable 230. Moreover, this alternative embodiment of the invention allows sensor 60*a* to have the same number of degrees of freedom (i.e., at least three degrees of freedom and as many as five) as printhead 50. This results in an increased number of degrees of freedom of movement for sensor 60*a* compared to the first embodiment of the invention. This is particularly useful to facilitate measurement of surfaces which are largely perpendicular to third axis 205.

It may be appreciated from the teachings herein that an advantage of the present invention is that marking medium is precisely applied evenly on predetermined portions of surface 30 in a time-saving manner. This is so because the automatic control provided by controller 220 allows printhead 50 to be spaced a constant distance from surface 30 by means of precise movement of positioning mechanism 160 and also allows the speed of the marking process to be increased compared to the manual marking technique. Printing may begin before the entire contour of the object is mapped. That is, once a sufficient number of points on the surface are determined the image data for such points may be adjusted and mapped to the contour or locations of points sensed and printing commenced. Where plural sensors are provided as in the embodiment of FIG. 5, the sensors may be used to map the contour of the object and that information used to map the image data for the respective printhead or printheads that are controlled by that sensor.

While the invention has been described with particular reference to its preferred embodiments, it is understood by those skilled in the art that various changes may be made and equivalents may be substituted for elements of the preferred embodiments without departing from the invention. For example, apparatus 10 is disclosed herein as applying color inks on surface 30 to create a printed color image; however, apparatus 10 may be modified in various respects. As another example, apparatus 10 may be modified to apply color glaze or other protective coating or pigments to predetermined portions of surface 30. As yet another example, support platform 45 may be suitably rotated rather than base 180. As still another example, support platform 45 may be movable vertically. Also, although the Cartesian coordinate system is used to map surface 30, the Polar coordinate system may be used instead. As a further example, color inkjet printhead 50 may be replaced by a suitable brush or pad marking device or other color marker or applicator.

As is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is an apparatus and method for marking a contoured surface having a complex topology.

PARTS LIST

10 apparatus
20 color image
30 surface
40 object
45 support platform
50 printhead
50*a* printhead
50*b* printhead
51*a* marker
51*b* marker
51*c* marker
51*d* marker
52 spot
53*a* line
53*b* line
53*c* line
53*d* line
60 sensor
60*a* sensor
61 sensor
70 light source
80 light beam
90 reflected light beam
100 light detector
110 sonic transducer
120 sound wave
130 reflected sound wave
140 sound detector
150 follower
155 end portion of follower
160 positioning mechanism
170 leg
175 first axis
180 base
190 beam member
192 second axis
195 first carriage
197 second carriage
199 third carriage
200 telescoping arm
200*a* telescoping arm
200*b* telescoping arm
201 clevis
202 pin
203 roller
204 pin
205 third axis
206 third axis
21 ball-in-socket pivotable joint
210*a,b* clevis and pin pivotable joint
211 ball-in-socket joint
215 lune
220 controller
230 first cable
230A second cable
231 fourth cable
240 second cable
250 third cable
260 reservoir
262*a* compartment
262*b* compartment
262 compartment
262*d* compartment
270–500 generalized process steps

What is claimed is:

1. An apparatus for printing on a three-dimensional contoured surface having a complex topography, comprising:

(a) a plurality of movable markers for printing an image on the surface with inks of different colors;

(b) a sensor or sensors disposed in sensing relationship to the surface for sensing position information of points on the surface prior to printing on the surface and generating first signals relative to the position information; and (c) a controller responsive to the first signals and in response to the first signals generating second signals to control position of the markers to effect complex movements of the markers through pivoting of the markers about a point or points, the controller also being responsive to image data represented as a two-dimensional plural color image to be printed on the surface and programmed to derive adjusted plural color image data that is adjusted in accordance with the three-dimensional contour of the surface.

2. The apparatus of claim 1 and wherein at least one of the markers is connected to a pivotable joint that supports the marker for the complex movement through pivoting about a point.

3. The apparatus of claim 1 and wherein said plurality of movable markers are simultaneously oriented at the same point or points in close proximity on the surface for printing at such point or points on the surface.

4. The apparatus of claim 3 and wherein respective pivotable joints are each coupled to a device that constrains movement of the respective joint in a linear fashion to adjust position of the respective joint and the respective marker connected to the respective joint.

5. The apparatus of claim 2 wherein the pivotable joint is a ball-in-socket coupling.

6. The apparatus of claim 1 and wherein each of the markers are inkjet printheads and each printhead is connected to a respective pivotable coupling that supports the respective printhead for pivoting movement and wherein the printheads are oriented at any one time to print at different locations on the surface for printing.

7. The apparatus of claim 6 and wherein the respective couplings are each coupled to a device that provides movement of the coupling in a linear fashion to adjust position of the coupling and the respective printhead connected to the coupling.

8. The apparatus of claim 1 and wherein each of the markers is connected to a pivotable coupling that supports the respective marker for pivoting movement and wherein the markers are oriented at any one time to print at different locations on the surface for printing.

9. A method of printing an image on a three-dimensional contoured surface having a complex topography, the method comprising:

sensing position information of points on the surface and generating signals relative to the position information;

providing image data representing a plural colored two-dimensional expression of the image to be printed;

adjusting the image data in response to the signals to define a plural colored three-dimensional expression of the image data that is adjusted for printing on the surface;

in response to the signals adjusting positions of a plurality of movable markers by at least one pivotable movement of the markers so as to locate the markers at locations for printing the image on the surface with inks of different colors; and ejecting inks from the plurality of movable markers in accordance with the plural colored three-dimensional expression of the image data.

10. The method of claim 9 and wherein the plurality of markers have inks of the different colors and the markers are simultaneously oriented at the same point or points in close proximity to the surface for printing at such point or points.

11. The method of claim 9 and wherein the plurality of markers have inks of the different colors and the markers are simultaneously oriented at respective different points on the surface for printing at such respective points.

12. The method of claim 9 and wherein the plurality of markers are adjustable relative to the surface with five degrees of freedom.

13. The method of claim 12, and wherein the plurality of markers are inkjet printheads.

14. The method of claim 9 and wherein the plurality of markers are inkjet printheads.

* * * * *